United States Patent [19]

Brekke et al.

[11] 4,155,611

[45] May 22, 1979

[54] CABINET ASSEMBLY

[75] Inventors: Bruce W. Brekke, Chaska; Jerald A. Morehouse, Shakopee, both of Minn.

[73] Assignee: DRI Industries, Inc., Eden Prairie, Minn.

[21] Appl. No.: 900,104

[22] Filed: Apr. 26, 1978

[51] Int. Cl.[2] ..... A47B 88/16; A47F 3/14

[52] U.S. Cl. ..... 312/348; 312/122

[58] Field of Search ..... 312/348, 330, 350, 119, 312/122, 111

[56] References Cited

U.S. PATENT DOCUMENTS

| | | | |
|---|---|---|---|
| 445,388 | 1/1891 | Block | 312/348 |
| 2,037,881 | 4/1936 | Clark | 312/122 |
| 2,176,913 | 10/1939 | Mandel | 312/330 |
| 2,964,371 | 12/1960 | Todd et al. | 312/122 |
| 2,988,411 | 6/1961 | Vannice | 312/348 |

FOREIGN PATENT DOCUMENTS

| | | | |
|---|---|---|---|
| 564438 | 9/1944 | United Kingdom | 312/348 |

*Primary Examiner*—Robert L. Wolfe
*Assistant Examiner*—Alex Grosz
*Attorney, Agent, or Firm*—Kinney, Lange, Westman and Fairbairn

[57] ABSTRACT

A cabinet assembly which is particularly useful in storing small hardware items such as nuts, bolts, screws, and washers, includes a plurality of drawers and a unitary molded plastic cabinet. The unitary molded plastic cabinet has an open back, a front formed of a grid of horizontal and vertical cross bar defining openings for the drawers, slides extending rearwardly from the grid for receiving and supporting the drawers, and a flange in each of the openings which extends downward from a horizontal cross bar and acts as a stop for both inward and outward travel of the drawer.

2 Claims, 5 Drawing Figures

CABINET ASSEMBLY

BACKGROUND OF THE INVENTION

The present invention relates to cabinet assemblies having a plurality of drawers arranged in rows and columns.

One continuing problem for the handyman is the storage of small hardware fasteners and other small items such as nuts, bolts, screws, washers, cotter pins, small nails and tacks, and so on. These items come in a variety of sizes and preferably should be separated to permit the handyman to find the item quickly when he needs it.

One solution to the storage problem in a small cabinet having a plurality of drawers arranged in rows and columns. Each drawer may contain one particular type of hardware item or may be divided into several individual compartments by dividers to hold two or more different hardware items. These cabinet assemblies have been available in the past and have proved to be extremely useful.

While the prior art cabinet assemblies have been technically satisfactory, further improvements are of interest. In particular, many of the cabinet assemblies have been made of sheet metal, which has required a significant amount of fabrication. As a result, the cost of materials and fabrication has been higher than is desirable. Further improvements in providing a simpler and lower cost cabinet assembly are needed.

SUMMARY OF THE INVENTION

The cabinet assembly of the present invention includes a plurality of drawers and a unitary molded plastic cabinet which receives and holds the drawers. The unitary molded plastic cabinet uses a minimum of plastic material and has a structure which permits easy removal of the cabinet from the mold. As a result, the cabinet is a low-cost, easily fabricated structure.

The unitary molded plastic cabinet includes top, bottom, and first and second side surfaces. The back of the cabinet is entirely open with no projections normal to the top, bottom, and first and second side surfaces. The front of the cabinet is a grid of vertical and horizontal cross bars which define openings for rows and columns of the drawers. L-shaped slides are positioned on each side of the defined opening and extend rearwardly from the grid so as to receive and support the drawers. A flange is positioned in each of the defined openings and extends downward from a horizontal cross bar. The front surface of the flange is slightly behind the plane of the front grid and acts against the inner top surface of the front of the drawer to limit inward travel of the drawer to a position in which the front of the drawers is substantially flush with the front grid. The back surface of the flange acts against the inner top surface of the back of the drawer to limit outward travel of the drawer.

DETAILED DESCRIPTION OF THE PREFERRED EMBODIMENTS

Figure 1:
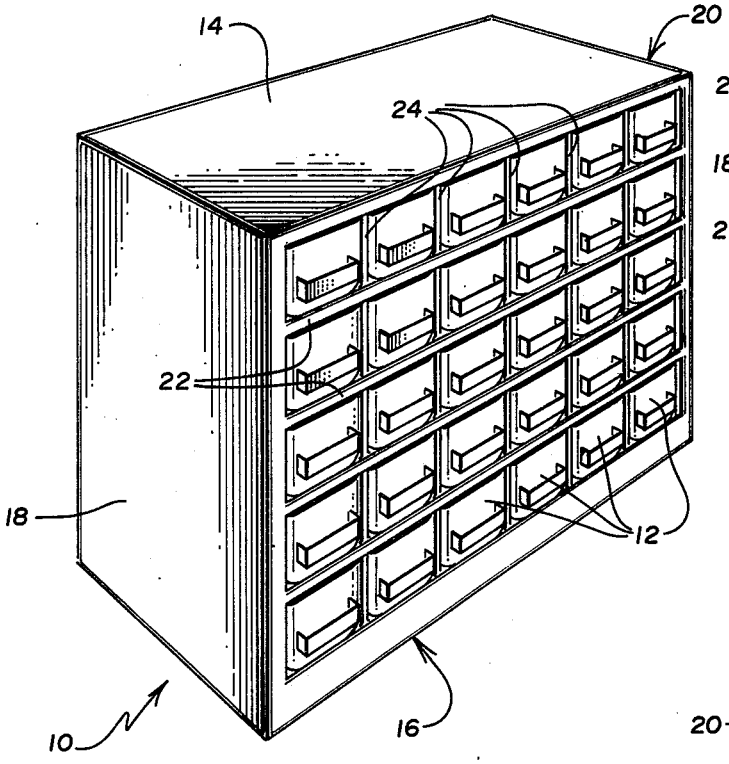
FIG. 1 is a perspective view of the cabinet assembly of the present invention.
Figure 2:
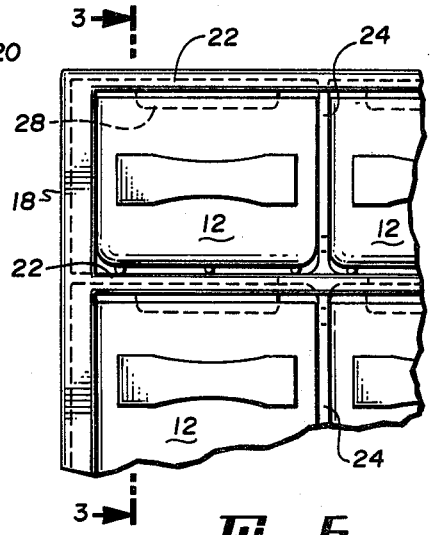
FIG. 2 is a front view of a portion of the cabinet assembly.
Figure 5:
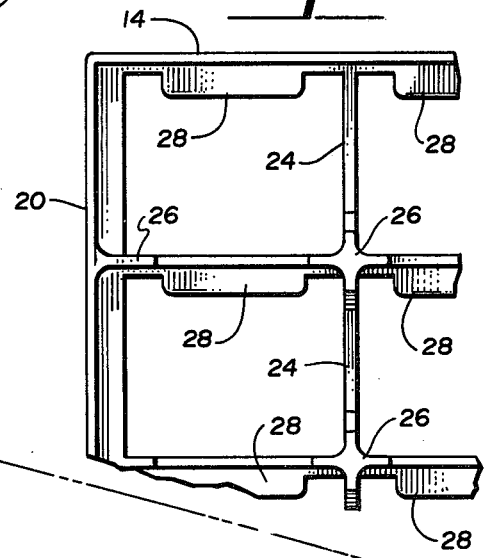
FIG. 5 is a rear view portion of the assembly with the drawers removed.

As shown in the Figures, the cabinet assembly of the present invention includes a unitary molded plastic cabinet 10 which receives and holds a plurality of individual drawers 12. In a preferred embodiment, drawers 12 are made of a clear, high-impact plastic.

Cabinet 10 is made of a suitable plastic such as molded polystyrene and includes a top 14, bottom 16, left side 18, and right side 20. The back of cabinet 10 is completely open, with no projections normal to the top, bottom, or left or right side surfaces.

The front of cabinet 10 includes a grid of horizontal cross bars 22 and vertical cross bars 24. Cross bars 22 and 24 define openings for rows and columns of drawers 12.

Integrally attached to cross bars 22 and 24 are L-shaped slides 26 which extend rearwardly from cross bars 22 and 24. L-shaped slides 26 are positioned on either side of each drawer to support and guide drawers 12 in both a vertical and horizontal direction. In the preferred embodiment shown in the Figures, slides 26 extend only part of the distance from the front surface toward the back. It has been found that a length of greater than one half but less than two thirds of the total depth of the cabinet provides the needed guiding and supporting of the drawers while using a minimum of plastic material and making it easier to withdraw the cabinet from the mold. It should be noted that the L-shaped slides 26 have no projections which would impede pulling of cabinet 10 from a mold by grasping cabinet 10 near the front and pulling it in a frontwards direction.

Figure 3:
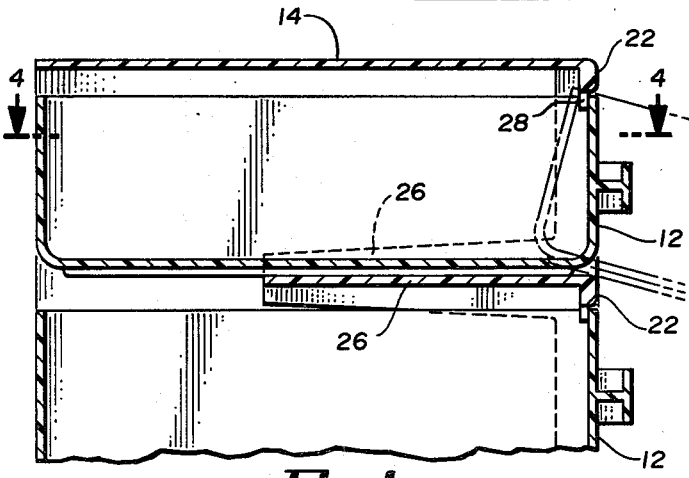
FIG. 3 is a sectional view along section 3—3 of FIG. 2.
Figure 3:
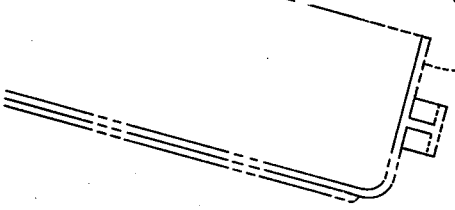
Figure 4:
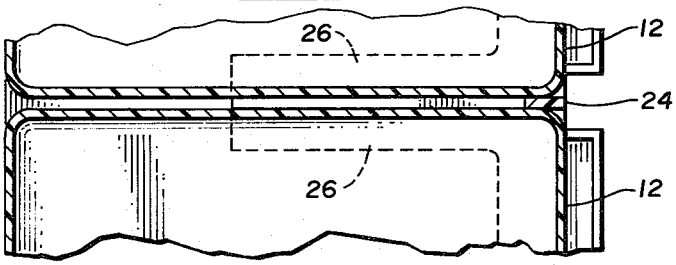
FIG. 4 is a sectional view along section 4—4 of FIG. 3.

Unitary molded plastic cabinet 10 also includes a plurality of downturned flanges 28, each of which extends downwardly from each of the horizontal cross bars 22 into one of the openings at the front surface of the cabinet. Flanges 28 are positioned slightly behind the plane of the front grid of cross bars 22 and 24. As shown in FIG. 3, flange 28 acts as a stop to limit the inward travel of drawer 12 by acting against the inner top surface of the front of drawer 12. When in this stopped position, the front surface of drawer 12 is substantially flush with the front of cabinet 10, due to the set back location of flanges 28.

FIG. 3 also illustrates, in phantom, how the back surface of flange 28 acts as a stop to limit outward travel of drawer 12. The inner top surface of the back of drawer 12 acts against flange 28 to limit outward travel and to hold the drawer in the outward extended position, which allows removal of the contents of drawer 12 without removing the drawer completely from cabinet 10. In this position, drawer 12 is also supported at its bottom surface by a portion of L-shaped slides 26 and horizontal cross bar 22.

It can be seen that drawer 12 can be removed from cabinet 10 by tipping the front end of drawer 12 upward to permit the bottom of drawer 12 to pass horizontal cross bar 22. The inner top surface of the back of drawer 12 then can pass below flange 28 and drawer 12 can be removed.

The cabinet assembly of the present invention, as shown in the Figures, uses a minimum of plastic material. In addition, there are no projections parallel to the front surface rearward of flange 28. It is extremely easy, therefore, to remove cabinet 10 from a mold. As a result, the entire cabinet structure can be molded as a unitary body. This minimizes the fabrication costs and assembly costs.

Although the present invention has been described with reference to preferred embodiments, workers skilled in the art will recognize that changes may be made in form and detail without departing from the spirit and scope of the invention.

What is claimed is:

1. A cabinet assembly comprising:

a plurality of drawers each having a front, a back, first and second sides, a bottom, and an at least partially open top; and a unitary molded plastic cabinet for receiving the plurality of drawers, said cabinet being molded from a minimum of plastic material and easily removable from the mold, said cabinet comprising:

a top surface;

a bottom surface;

first and second side surfaces;

an open back with no projections normal to the top, bottom, or first and second side surfaces;

a front comprising a grid of vertical and horizontal cross bars defining openings for rows and columns of the drawers;

slides on each side of each defined opening extending rearwardly from the grid for receiving and supporting the drawers rearwardly from the grid by a distance of between about one half and about two thirds of the distance from the front to the open back; and a flange in each of the defined openings extending downward from a horizontal cross bar, the flange being positioned with its front surface slightly behind the plane of the front grid to act against an inner top surface of the front of the drawer to limit inward travel of the drawer to a position in which the front of the drawer is substantially flush with the front grid, and the back surface of the flange acting against an inner top surface of the back of the drawer to limit outward travel of the drawer, the back surface of the flange being substantially coplanar with the back surface of the front grid, and wherein the cabinet has no substantial projection from the top, bottom and first and second side surfaces parallel to the front grid and rearward of the back surface of the front grid.

2. The cabinet assembly of claim 1 wherein the slides are L-shaped slides for limiting vertical and transverse horizontal movement of the drawers.

* * * * *